US008863959B1

(12) United States Patent
Britton et al.

(10) Patent No.: US 8,863,959 B1
(45) Date of Patent: Oct. 21, 2014

(54) VIBRATORY SEPARATOR

(75) Inventors: Dan Britton, Barrington, IL (US); Daniel T. Lease, Spring Grove, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 341 days.

(21) Appl. No.: 12/573,666

(22) Filed: Oct. 5, 2009

Related U.S. Application Data

(60) Provisional application No. 61/102,616, filed on Oct. 3, 2008.

(51) Int. Cl.
*B03B 9/06* (2006.01)

(52) U.S. Cl.
USPC ..... 209/11

(58) Field of Classification Search
USPC ..... 209/11
IPC ..... B01D 33/0315; C10L 9/00; B03B 1/04
See application file for complete search history.

(56) References Cited

U.S. PATENT DOCUMENTS 984,866 A * 2/1911 Tate ..... 209/467
1,667,331 A * 4/1928 O'Toole ..... 209/44
1,941,212 A * 12/1933 Johnson ..... 209/2
2,094,786 A * 10/1937 Flint ..... 34/164
3,016,203 A * 1/1962 Sears et al. ..... 241/24.1
3,027,652 A * 4/1962 Wallace ..... 34/424
3,531,826 A * 10/1970 Patrick ..... 425/143
3,799,334 A * 3/1974 Collins ..... 209/11
3,897,910 A * 8/1975 Deve ..... 241/77
3,972,808 A * 8/1976 Manley ..... 209/133
4,063,903 A * 12/1977 Beningson et al. ..... 44/629
4,123,209 A * 10/1978 Moore ..... 425/74
4,145,483 A * 3/1979 Bonnemay et al. ..... 429/103
4,344,770 A * 8/1982 Capener et al. ..... 44/388
4,492,629 A * 1/1985 Dumbaugh ..... 209/332
4,598,875 A * 7/1986 Bronson et al. ..... 241/78
4,715,950 A * 12/1987 Danner et al. ..... 209/20
4,784,334 A * 11/1988 Van Der Veer et al. ..... 241/14
4,970,971 A * 11/1990 Williams ..... 110/346
4,971,684 A * 11/1990 Mueller ..... 209/44
5,062,601 A * 11/1991 Graf ..... 241/79.3
5,103,981 A * 4/1992 Abbott et al. ..... 209/37
5,199,574 A * 4/1993 Hollyfield et al. ..... 209/315
5,219,078 A * 6/1993 Hadden ..... 209/234
5,236,596 A * 8/1993 Greenwald, Sr. ..... 210/696
5,246,174 A * 9/1993 Vitunac et al. ..... 241/94
5,322,170 A * 6/1994 Hadden ..... 209/314
5,431,939 A * 7/1995 Cox et al. ..... 426/300
5,614,094 A * 3/1997 Deister et al. ..... 210/388
5,641,071 A * 6/1997 Read et al. ..... 209/319

(Continued)

*Primary Examiner* — Stefanos Karmis
*Assistant Examiner* — Michael E Butler
(74) *Attorney, Agent, or Firm* — Marshall, Gerstein & Borun LLP

(57) ABSTRACT

A separator includes a trough having an inlet end, an outlet end, and a bottom wall, and a vibration generator attached to the trough. The separator also includes first, second, and third deck sections, each of which is disposed within the trough, the first deck section being disposed at a higher elevation relative to the bottom wall than the second deck section, and the third deck section being disposed above the second deck section. The separator also includes at least one source of heated air, the first deck section and the second deck section being in fluid communication with the at least one source of heated air so that heated air from the at least one source passes through the first and second deck sections.

13 Claims, 3 Drawing Sheets

(56) References Cited

U.S. PATENT DOCUMENTS

| | | | | | |
|---|---|---|---|---|---|
| 5,769,240 | A * | 6/1998 | Middour et al. | 209/314 |
| 5,816,412 | A * | 10/1998 | Bokor | 209/326 |
| 5,882,381 | A * | 3/1999 | Hauck et al. | 95/109 |
| 5,921,401 | A * | 7/1999 | Johnston | 209/315 |
| 6,116,428 | A * | 9/2000 | Loshe | 209/319 |
| 6,544,425 | B2 * | 4/2003 | Miller | 210/710 |
| 6,572,040 | B1 * | 6/2003 | Brown, Jr. | 241/162 |
| 7,111,739 | B2 * | 9/2006 | Tsutsumi | 209/315 |
| 2007/0045158 | A1 * | 3/2007 | Johnson | 209/11 |
| 2007/0089805 | A1 * | 4/2007 | Swaan et al. | 144/1.1 |
| 2008/0029442 | A1 * | 2/2008 | Schulte et al. | 209/333 |
| 2008/0201980 | A1 * | 8/2008 | Bullinger et al. | 34/493 |
| 2009/0226662 | A1 * | 9/2009 | Dyczko-Riglin et al. | 428/95 |

* cited by examiner

VIBRATORY SEPARATOR

This application claims the benefit of U.S. Application No. 61/102,616, filed Oct. 3, 2008, which is hereby incorporated by reference in its entirety in the present application.

BACKGROUND

This patent is directed to a vibratory apparatus, and, in particular, to a vibratory apparatus suitable to separate a mixed material product.

Quite often in the recycling industry, it is necessary to process a mixed material product. One such mixed material product is referred to as 3-mix. The mixed material product may include broken glass, paper, plastic, and food waste. Conventionally, 3-mix has been separated using a 2½" screen.

SUMMARY

According to an aspect of the present disclosure, a separator includes a trough having an inlet end, an outlet end, and a bottom wall, and a vibration generator attached to the trough, the vibration generator causing a mixed material product and separated materials to move between the inlet end and the outlet end. The separator also includes a first deck section, a second deck section, and a third deck section, each of which is disposed within the trough, the first deck section being disposed at a higher elevation relative to the bottom wall than the second deck section, and the third deck section being disposed above the second deck section. The separator also includes at least one source of heated air, the first deck section and the second deck section being in fluid communication with the at least one source of heated air so that heated air from the at least one source passes through the first and second deck sections.

According to another aspect of the present disclosure, a method of separating a mixed material product into separated materials includes vibrating a first deck section, a second deck section, and a third deck section, the first deck section being disposed at a higher elevation relative to a bottom wall than the second deck section, and the third deck section being disposed above the second deck section. The method also includes passing heated air through the first deck section to fluidize the mixed material product, and passing heated air through the second deck section to separate materials passing over the third deck section and dry materials passing over the second deck section.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
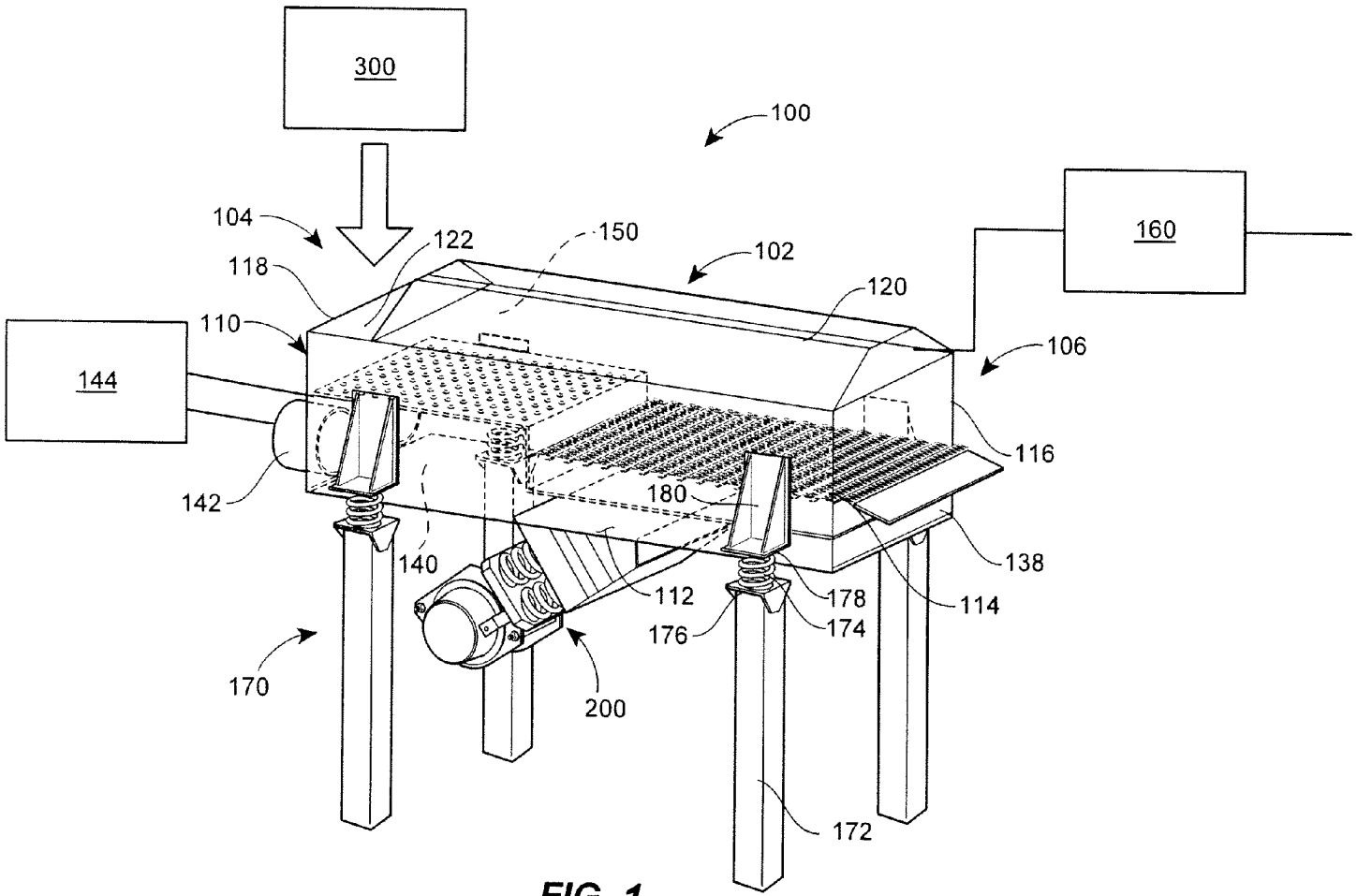
FIG. 1 is a perspective view of a vibratory apparatus according to the present disclosure in combination with a schematic view of other elements of the associated system.

FIG. 1 illustrates a system 100 including a vibratory apparatus 102, which is being used to separate a mixed material product and to convey the product and the separated materials from an inlet end 104 to an outlet end 106. According to at least an illustrated embodiment, the vibratory apparatus 102 may also heat and dry the mixed material product and the separated materials as they are conveyed from the inlet end 104 to the outlet end 106.

In particular, the vibratory apparatus 102 may include a trough 110 with a bottom wall 112, opposing side walls 114, 116 and an end wall 118. The trough 110 may also be fitted with a hood 120 that extends from the inlet end 104 to the outlet end 106 of the trough 110. An opening 122 is defined by the side walls 114, 116, end wall 118 and hood 120 through which the mixed material product is introduced into the vibratory apparatus 102.

Figure 2:
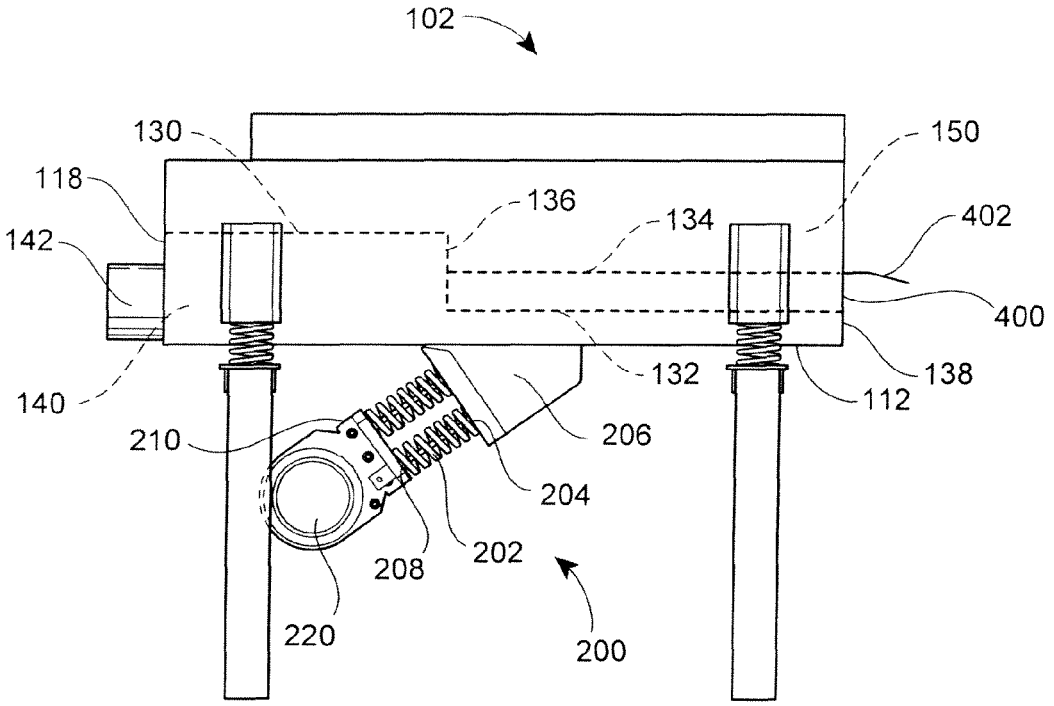
FIG. 2 is a side view of the vibratory apparatus of FIG. 1.
Figure 3:
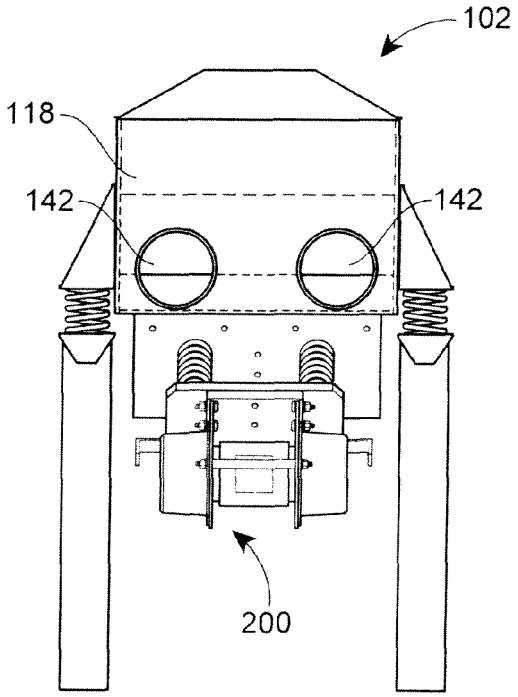
FIG. 3 is an end view of a vibratory apparatus of FIG. 1.
Figure 4:
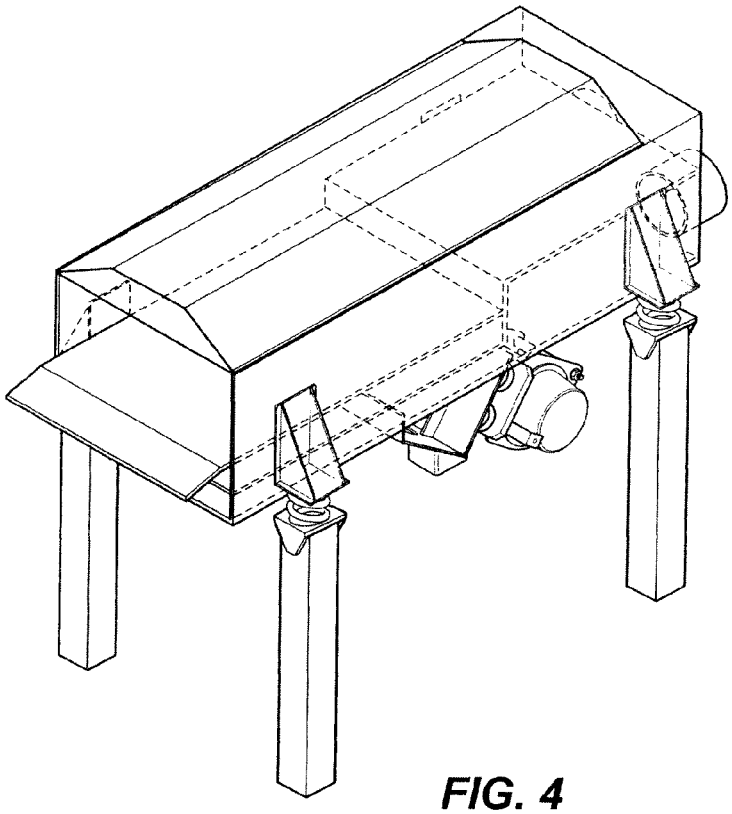
FIG. 4 is a perspective view of the vibratory apparatus of FIG. 1, taken from an outlet end.
Figure 5:
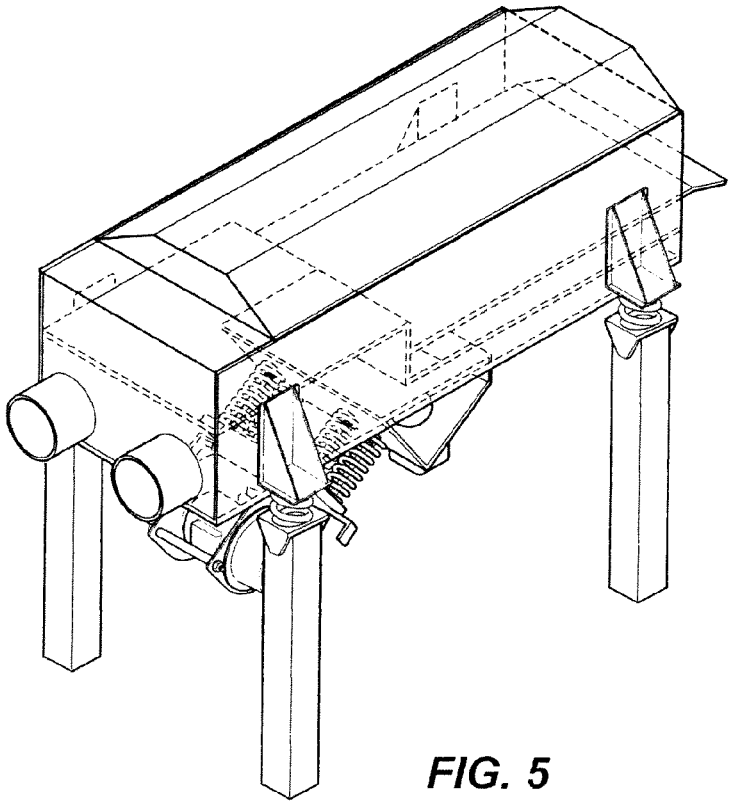
FIG. 5 is a perspective view of the vibratory apparatus of FIG. 1, taken from an inlet end.

As best seen in FIG. 2, supported between the side walls 114, 116 and above the bottom wall 112 are several deck sections 130, 132, 134. The first and second deck sections 130, 132 are supported between the side walls 114, 116 at different elevations above the bottom wall 112. The third deck section 134, which may be a screen (such as finger screen), may be supported between the side walls 114, 116 above the second deck section 132. The third deck section 134 may also be disposed at an elevation below the first deck section 130, as shown, or at the same elevation (parallel with) the first deck section 130. It is believed that the third deck section 134 may be advantageously defined by a finger deck with 1½" finger openings when used for separation of 3-mix, as described below. As a variant, the third deck section 134 may be adjustable so as to be disposed at an angle relative to the first deck section 130, thereby permitting the third deck section 134 to slow the motion of materials along the third deck section 134 and out of the outlet end 106.

As also seen in FIG. 2, the first and second deck sections 130, 132 are connected by a connecting wall 136, and the second deck section 132 is connected to the bottom wall 112 by a connecting wall 138. The bottom wall 112, side walls 114, 116, end wall 118, deck sections 130, 132 and connecting walls 136, 138 define a plenum 140 that is in fluid communication with the deck sections 130, 132. Two inlets 142 are provided in the end wall 118 to connect the plenum 140 with a source of air 144 (see FIG. 1). The air source 144 may include, for example, a gas-fired burner to heat the air and a fan to move the air into the plenum 140. It will be recognized that other air sources 144 may be used in the alternative, and other inlet arrangements may be provided.

The first and second deck sections 130, 132 have orifices, holes, etc. (e.g., may be described as perforated) and/or louvers to permit the air that passes into the plenum 140 to pass through the deck sections 130, 132 into a space 150 defined in part by the side walls 114, 116, end wall 118, and hood 120. In particular, the air exiting the second deck section 132 also passes through the third deck section 134. The air passes from the space 150 into the hood 120, and from the hood 120 to an optional processing unit 160. The processing unit 160 may include one or more of a cyclone, a dust collector, an oxidizer, etc. to process the air exiting the apparatus 102 through the hood 120.

The trough 110 may be supported on a frame 170 including several legs 172. In particular, one or more resilient members 174, such as coil springs as shown, may be disposed between the trough 110 and the frame 170. These resilient members 174, which may be referred to as isolation springs, may be connected at a first end 176 to one of the legs 172 and at a second end 178 to a bracket 180 attached to the trough 110.

A vibration generator 200 may be attached to the trough 110 to cause the mixed material product and separated materials to move between the inlet end 104 and the outlet end 106. As best seen in FIG. 2, the vibration generator 200 may include one or more resilient members 202, which may be coil springs as illustrated, that are attached at a first end 204 to a mounting bracket 206 attached in turn to the trough 110, and at a second end 208 to a plate 210. The resilient members 202 may also be referred to as reactor springs. A motor 220 is also attached to the plate 210, and has a shaft with one or more eccentric weights attached thereto. Activation of the motor 220 causes vibration of the trough 110, and according to an exemplary embodiment, the vibration generator may provide a near vertical stroke.

It will be recognized that while one vibration generator has been described, a variety of other generators may be used. For example, rather than a two-mass arrangement, a brute force arrangement (i.e., where the generator is attached directly to the trough 110) may be used. Further, other prime movers may be used in place of the motor, such as pneumatic or hydraulic linear drives. For that matter, the reactor springs may be paired with pivoting linkages in a variety of arrangements. All such variations are within the scope of the present disclosure.

According to one exemplary use, the system 100 may be used to remove the moisture from a mixed material product and to separate the mixed material product to provide a substantially separated and dry material stream at the outlet end 106. Where the mixed material product is a 3-mix, the desired material stream at the outlet end 106 may be glass or glass pieces, for example.

Referring then to FIG. 1, the mixed material product may enter the apparatus 102 at the inlet end 104 from a feeder or belt conveyor 300 at a controlled feed rate. The mixed material product will fall through the opening 122 directly onto the first deck section 130, which may also be referred to as the first fluidizing section of the apparatus 102. As the mixed material product travels in the direction of the outlet end 106, hot air passes through the first deck section 130 and comes in contact with the mixed material product.

The hot air passing through the first deck section 130 may be approximately 150 degrees Fahrenheit, for example. It is believed that hot air at this temperature will begin to drive off the moisture from the mixed material product to enhance the separation of the included paper and plastic. The length of the first deck section 130 may be selected to be long enough so as to dry the mixed material product and to begin the separation of the lighter weight materials (the "lights") from the heavier weight material (the "heavies").

As the mixed material product transitions from the first deck section 130 to the third deck section 134, the product may pass over a step. The movement from the higher elevation of the first deck section 130 to the lower elevation of the third deck section 134 may have a "fluffing" effect on the product. However, as described above, the step-down between the first and third deck sections 130, 134 is optional, and may not be included in all instances.

According to either variant, the product continues on its journey over the third deck section 134. Because of their size, larger pieces of paper and plastic bottles will remain on top of the third deck section 134. Because of the underlying fluidizing section defined by the second deck section 132, it is believed that there will be sufficient air pressure under the third deck section 134 to also prevent the smaller lights (such as small pieces of paper) from falling through the deck section 134.

On the other hand, it is believed that the heavies, including the glass pieces, will pass through the third deck section 134 and come to rest on the second deck section 132. The hot air passing through the second deck section 132 may then dry the glass material before it discharges from the apparatus 102 at the outlet end 106 at 400 (see FIG. 2), onto a conveyor, for example. All of the material passing over the deck section 134 will discharge from the apparatus 102 at the outlet end 106 at 402 (see FIG. 2), and onto a separate conveyor, for example.

At the present time, it is believed that a 1" stroke should be sufficient to fluff and agitate the mixed material product. Such a stroke would also limit the travel speed of the material in the apparatus 102 to permit adequate time for drying by the heated air.

It is believed that the present disclosure may have several benefits, one or more of which may be present in a particular embodiment according to the present disclosure.

We claim:

1. A separator comprising:

a trough having an inlet end, an outlet end, and a bottom wall;

a vibration generator attached to the trough, the vibration generator causing a mixed material product and separated materials to move between the inlet end and the outlet end;

a first deck section, a second deck section, and a third deck section, each of which is disposed within the trough, the first deck section being disposed at a higher elevation relative to the bottom wall than the second deck section, and the third deck section being disposed directly vertically above the second deck section, the first deck section having an upstream edge and a downstream edge, and the third deck section having an upstream edge and a downstream edge, and the downstream edge of the first deck section is connected to upstream edge of the third deck section, the third deck section being defined by at least one screen, and the first and second deck sections being perforated or including louvers;

a connecting wall, the downstream edge of the first deck section and the upstream edge of the third deck section being attached to the connecting wall, the second deck section having an upstream edge and a downstream edge, with the upstream edge of the second deck section being attached to the connecting wall, and the upstream edge of the third deck section being disposed directly vertically above the upstream edge of the second deck section and the downstream edge of the third deck section being disposed directly vertically above the downstream edge of the second deck section to define a space between the second and third deck sections;

an end wall connected to the upstream edge of the first deck section and the bottom wall;

a further connecting wall attached to the downstream edge of the second deck section and the bottom wall;

a plenum, the plenum defined below the first deck section, the connecting wall, and the second deck section, directly vertically above the bottom wall, and between the end wall and the further connecting wall; and at least one source of heated air, the first deck section and the second deck section being in fluid communication with the at least one source of heated air so that heated air from the at least one source passes through the first and second deck sections, the plenum connected to the at least one source of heated air.

2. The separator according to claim 1, wherein the at least one source of heated air includes a gas-fired burner and a fan.

3. The separator according to claim 1, further comprising a hood attached to the trough directly vertically above the first, second and third deck sections.

4. The separator according to claim 3, further comprising a processing unit connected to the hood, air that passes through the first, second and third deck sections passes through the hood into the processing unit, the processing unit including one or more of a cyclone, a dust collector, and an oxidizer.

5. The separator according to claim 1, wherein the first deck section is at a higher elevation that the third deck section.

6. The separator according to claim 1, further comprising one or more resilient members, having their first ends connected to a frame and their second ends connected to the trough.

7. The separator according to claim 1, wherein the vibration generator includes one or more resilient members attached at a first end to the trough and at a second end to a motor, the motor having a shaft with one or more eccentric weights attached thereto.

8. The separator according to claim 1, wherein the third deck section overlies the entire second deck section.

9. The separator according to claim 1, wherein the downstream edge of the first deck section is at a higher elevation than the upstream edge of the third deck section.

10. The separator according to claim 1, further comprising at least one inlet provided in the end wall and connected to the at least one source of heated air.

11. The separator according to claim 1, wherein the third deck section is defined by at least one finger screen.

12. The separator according to claim 1, the trough further comprising side walls, the first, second and third deck sections and the connecting wall supported between, orthogonal to and attached to the side walls.

13. The separator according to claim 12, further comprising a hood attached to the trough directly vertically above the first, second and third deck sections, the hood and the side walls defining an opening through which product is introduced into the trough.

* * * * *